US006425730B1

(12) United States Patent
Kaczmarski

(10) Patent No.: US 6,425,730 B1
(45) Date of Patent: Jul. 30, 2002

(54) LOAD BEARING PIVOT ASSEMBLY PROVIDING A FLUID PATH

(75) Inventor: Wally L. Kaczmarski, Lisbon, ND (US)

(73) Assignee: Clark Equipment Company, Woodcliff Lake, NJ (US)

( * ) Notice: Subject to any disclaimer, the term of this patent is extended or adjusted under 35 U.S.C. 154(b) by 0 days.

(21) Appl. No.: 09/248,679

(22) Filed: Feb. 11, 1999

(51) Int. Cl.[7] ..... E02F 9/00
(52) U.S. Cl. ..... 414/723; 37/468
(58) Field of Search ..... 414/680, 686, 414/723; 37/468; 172/272–275

(56) References Cited

U.S. PATENT DOCUMENTS

| | | | | |
|---|---|---|---|---|
| 1,891,670 A | * | 12/1932 | Ernst | |
| 3,399,786 A | * | 9/1968 | Honeycutt | 212/58 |
| 3,442,539 A | * | 5/1969 | Randall | 285/190 |
| 3,627,355 A | * | 12/1971 | Reddy | 285/110 |
| 3,776,403 A | * | 12/1973 | Billings | 214/137 |
| 3,873,133 A | * | 3/1975 | Berg et al. | 285/136 |
| 4,193,734 A | * | 3/1980 | Williams | 414/694 |
| 4,767,257 A | * | 8/1988 | Kato | 414/744 |
| 4,798,511 A | * | 1/1989 | Kaczmarczyk et al. | 414/918 X |
| 5,108,253 A | * | 4/1992 | Kobayashi et al. | 414/694 |
| 5,156,422 A | * | 10/1992 | Shibano | 285/133.1 |
| 5,232,330 A | * | 8/1993 | Rae et al. | 414/686 |
| 5,299,857 A | * | 4/1994 | Zanetis | 299/39 |
| 5,967,738 A | * | 10/1999 | Warthold | 414/723 |

FOREIGN PATENT DOCUMENTS

CA 2216299 * 8/1998

OTHER PUBLICATIONS

Drawings for Super Swivels (3 pages), published prior to Jun. 1, 1998.*

* cited by examiner

*Primary Examiner*—Donald W. Underwood
(74) *Attorney, Agent, or Firm*—Westman, Champlin & Kelly, P.A.

(57) ABSTRACT

An improved load bearing pivot assembly for connecting the boom arm of a power machine to the main frame, or the implement (e.g., adapter plate) or both. The load bearing pivot assembly provides a fluid path therethrough in order to eliminate fluid lines at the pivot point which are otherwise susceptible to failure due to repeated flexure and due to being exposed to an abusive environment. Both portions of the pivot assembly preferably include a coupler for connection to a fluid line. One of the fluid lines is connected to a source of pressurized hydraulic fluid and the other line is adapted for connection to an attachment requiring pressurized hydraulic fluid for operation. Such attachments include, but are not limited to, grapples, rotary brooms, augers, tree spades, jack hammers, etc. The fluid lines are preferably at least partially contained within the boom and/or the implement to protect the lines from exposure to the abusive environment.

17 Claims, 5 Drawing Sheets

(DETAIL A)

LOAD BEARING PIVOT ASSEMBLY PROVIDING A FLUID PATH

BACKGROUND OF THE INVENTION

The present invention generally relates to power machines such as front end loaders and skid steer loaders. More specifically, the present invention relates to a load bearing pivot assembly for connecting a boom arm of a power machine to the main frame or an implement (e.g., adapter plate) or both.

Power machines, such as front end loaders and skid steer loaders, typically have a main frame which supports a cab or an operator compartment and a movable boom arm which, in turn, supports an implement. The implement is typically an adapter plate capable of releasable connection to an attachment such as a bucket or an attachment requiring pressurized hydraulic fluid for operation such as an auger, a snowblower, a stump grinder, a hydraulic breaker, or the like. The movable boom arm is pivotally coupled to the main frame of the power machine and is powered by power actuators which are commonly hydraulic cylinders. In addition, the attachment coupled to the implement (i.e. the adapter plate) is typically powered by one or more additional power actuators which are also commonly hydraulic cylinders. An operator manipulating such a power machine raises and lowers the boom arm, and manipulates the attachment, by actuating the hydraulic cylinders coupled to the boom arm, and the hydraulic cylinders coupled to the attachment.

An attachment requiring pressurized hydraulic fluid for operation typically receives the hydraulic fluid through hydraulic lines or hoses. The hydraulic lines are routed along the boom arm to the distal end of the boom arm where a connection is made to the attachment. Quick couplers may be mounted to the hydraulic lines for quick connection to the attachment. However, routing the pressurized hydraulic lines along the boom arm to the attachment renders the hydraulic lines susceptible to failure due to repeated flexure and due to exposure to the surrounding abusive environment.

SUMMARY OF THE INVENTION

The present invention provides an improved load bearing pivot assembly for connecting the boom arm of a power machine such as a front end loader to the main frame, or the implement (e.g., adapter plate) or both. The load bearing pivot assembly provides a fluid path therethrough in order to eliminate fluid lines at the pivot point which are otherwise susceptible to failure due to repeated flexure and due to being exposed to an abusive environment.

In one embodiment of the present invention, a power machine having a boom arm and an implement (e.g., an adapter plate) is provided with a load bearing pivot assembly for pivotally connecting the implement to the distal end of the boom arm. The pivot assembly includes a two portions, one connected to the boom and the other connected to the implement. Each portion has a fluid path which are in fluid communication with each other. The fluid paths eliminate the need for a fluid line (e.g., a hose) at the pivot point which would otherwise be exposed to continuous bending.

Both portions of the pivot assembly preferably include a coupler for connection to a fluid line. One of the fluid lines is connected to a source of pressurized hydraulic fluid and the other line is adapted for connection to an attachment requiring pressurized hydraulic fluid for operation. Such attachments include, but are not limited to, grapples, augers, tree spades, jack hammers, etc. The fluid lines are preferably at least partially contained within the boom and/or the implement to protect the lines from exposure to the abusive environment.

The fluid line that is adapted for connection to an attachment may be connected to a movable (e.g. slidable, rotatable) block mounted on the implement. The movable block includes a coupler for releasable connection to the attachment. With this arrangement, a connection to the attachment may be accomplished by maneuvering the implement and block with the loader rather than by manually connecting the line to the attachment.

One of the portions of the pivot assembly preferably comprises a pin. The other portion of the pivot assembly preferably comprises an annular bearing surrounding the pin. The pin may include an annular recess, a lateral channel and a longitudinal channel which comprise a fluid path. The annular bearing may include a gap which comprises another fluid path in fluid communication with the fluid path of the pin. The bearing preferably includes a bearing surface which is lubricated by the fluids in the fluid paths.

In another embodiment of the present invention, a power machine having two boom arms and an implement (e.g., an adapter plate) is provided with two load bearing pivot assemblies, one for pivotally connecting each boom arm to the implement. Each pivot assembly includes a fluid path therethrough. The fluid paths eliminate the need for fluid lines (e.g., hoses) at the pivot points which would otherwise be exposed to continuous bending.

In yet another embodiment of the present invention, a power machine having a main frame assembly and a boom arm includes a load bearing pivot assembly for pivotally connecting the main frame to the proximal end of the boom arm. The pivot assembly includes a fluid path defined therethrough. The pivot assembly preferably includes a pin and an annular bearing surrounding the pin. The pin may include an annular recess, a lateral channel and a longitudinal channel which comprise a fluid path. The annular bearing may include a gap which comprises another fluid path in fluid communication with the fluid path of the pin. The bearing preferably includes a bearing surface which is lubricated by the fluid in the fluid paths.

DETAILED DESCRIPTION OF THE PREFERRED EMBODIMENTS

The following detailed description should be read with reference to the drawings in which like elements in different drawings are numbered the same. The drawings, which are not necessarily to scale, depict selected embodiments that illustrate the invention but are not intended to limit the scope of the invention. Those skilled in the art will recognize that many of the examples provided have suitable alternatives which may also be utilized without departing from the scope and spirit of the invention.

Figure 1:
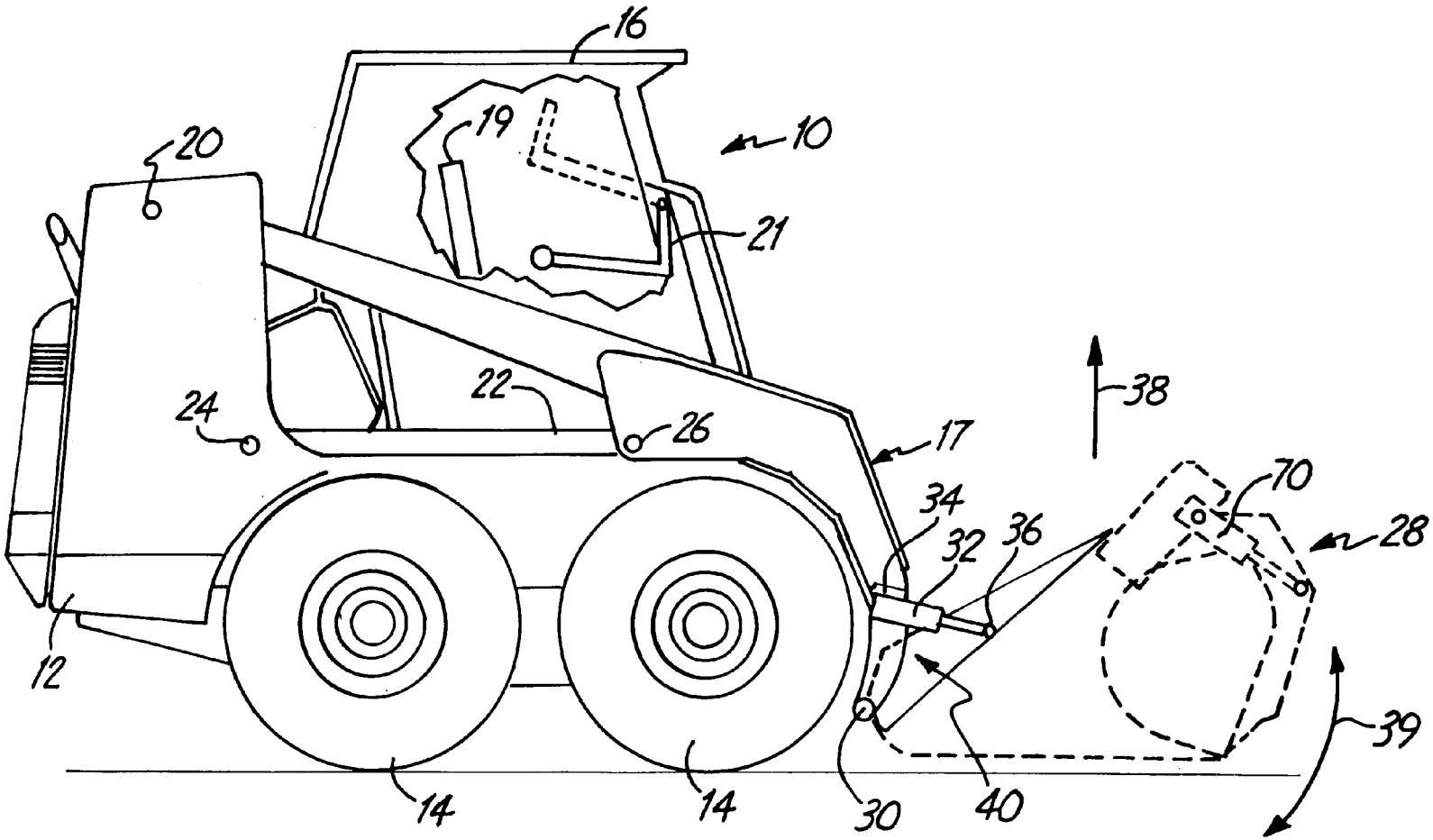
FIG. 1 is a side view of a power machine, in particular, a skid steer loader, as in the present invention.

Refer now to FIG. 1 which illustrates a side view of a power machine, specifically a skid steer loader, of the present invention. Although the following detailed description is focused on a skid steer loader, those skilled in the art will recognize that the essence of the present invention may be implemented on a wide variety of power machines including front end loaders and skid steer loader 10.

Skid steer loader 10 includes a frame 12 supported by wheels 14. Frame 12 also supports a cab 16 which defines an operator compartment and which substantially encloses a seat 19 on which an operator sits to control skid steer loader 10. A seat bar 21 is pivotally coupled to a portion of cab 16. When the operator occupies seat 19, the operator then pivots the seat bar 21 from the raised position (shown in phantom in FIG. 1) to the lowered position shown in FIG. 1.

A pair of boom arms or lift arms 17 are coupled to frame 12 at pivot points 20 (only one of which is shown in FIG. 1, the other being identically disposed on the opposite side of the loader 10). A pair of hydraulic cylinders (only one of which is shown in FIG. 1) are pivotally coupled to frame 12 at pivot point 24 and are pivotally coupled to boom arms 17 at pivot points 26. Boom arms 17 are also coupled to a quick attachment adapter plate 40 which in turn is connected to an attachment, such as a bucket and grapple 28 shown in phantom in FIG. 1. Boom arms 17 are pivotally coupled to the adapter plate 40 at pivot points 30. In addition, a hydraulic cylinder 32 is pivotally coupled to a cross member extending between the boom arms 17 at pivot point 34 and to the adapter plate 40 at pivot point 36. While one cylinder 32 is shown, it is to be understood that two cylinders could be used to manipulate the adapter plate 40.

The adapter plate 40, in this specific embodiment, is adapted to be releasably coupled to an attachment such as the bucket and grapple 28 shown in phantom. Adapter plate 40 is generically referred to herein as an implement and bucket and grapple 28 are collectively referred to herein as an attachment. For purposes of illustration only, the implement is described in detail as an adapter plate 40. Similarly, for purposes of illustration only, the attachment is illustrated in detail as a bucket and grapple 28. The implement of the present invention includes any structure connecting the boom arms 17 to an attachment. Similarly, the attachments contemplated by the present invention include any attachment requiring pressurized hydraulic fluid for operation which may be mounted to the implement, such as adapter plate 40, in place of bucket and grapple 28. A more detailed description of adapter plate 40 is provided with reference to FIG. 2.

The operator, residing in cab 16, is able to manipulate boom arms 17 and adapter plate 40 connected to an attachment 28 by selectively actuating hydraulic cylinders 22 and 32. By actuating hydraulic cylinders 22 and causing the hydraulic cylinders 22 to increase in length, the operator moves boom arms 17 and consequently adapter plate 40 and any attachment 28 thereto, generally upward in the direction indicated by arrow 38. Conversely, when the operator actuates cylinder 22 and causes it to decrease in length, adapter plate 40 and the attachment 28 moves generally vertically downward to the position shown in FIG. 1.

The operator is also able to manipulate (i.e. tilt) the adapter plate 40 by actuating cylinder 32. When the operator causes cylinder 32 to increase in length, the adapter plate 40 tilts forward about pivot points 30. Conversely, when the operator causes cylinder 32 to decrease in length, the adapter plate 40 tilts rearward about pivot point 30. The tilting is generally along an arcuate path as indicated by arrow 39.

Adapter plate 40 is suitable for connection to a bucket and grapple 28 shown in phantom in FIG. 1. Adapter plate 40 is also suitable for connection to a number of attachments, including power attachments requiring pressurized hydraulic fluid. The pressurized hydraulic fluid may be used to power any hydraulic motor including rotary motors and linear actuators, both of which are generically referred to herein as hydraulic motors. Examples of attachments requiring pressurized hydraulic fluid include, but are not limited to, grapples, cement mixers, tree spades, jackhammer, augers, etc. For purposes of illustration only, the bucket and grapple 28 shown in phantom in FIG. 1 does require pressurized hydraulic fluid.

It is contemplated that the adapter plate 40 is suitable for connection to a wide variety of attachments including attachments requiring pressurized hydraulic fluid for operation and attachments not requiring pressurized hydraulic fluid. It is particularly desirable to have an adapter plate 40 suitable for connection to a wide variety of attachments, independent of the power requirements of the attachment. Accordingly, the present invention is not limited to power machines having an attachment requiring pressurized hydraulic fluid, but rather, includes power machines capable of powering and connecting to an attachment requiring pressurized hydraulic fluid.

Figure 2:
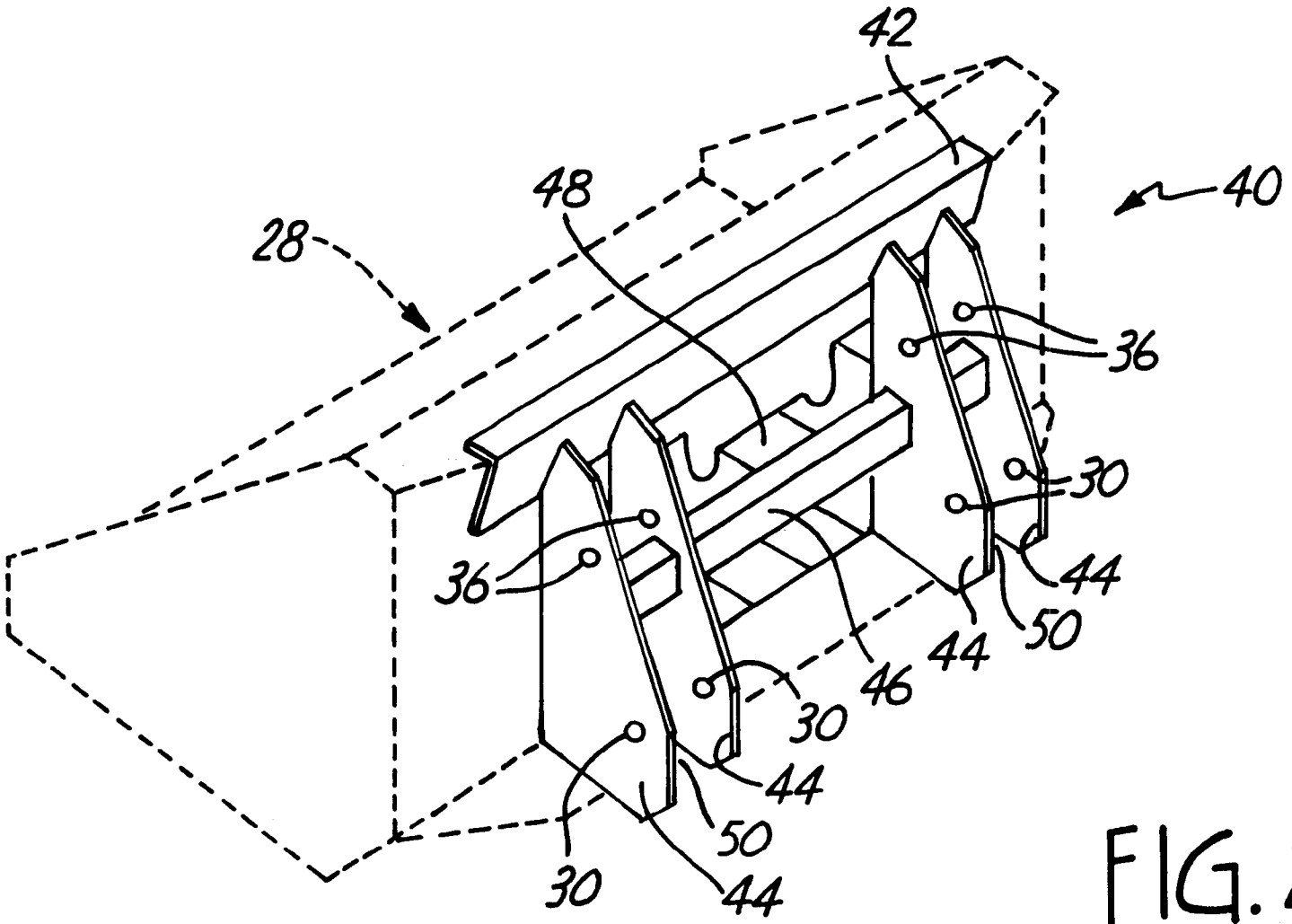
FIG. 2 is a perspective view of an implement in the form of an adapter as in the present invention.

Refer now to FIG. 2 which illustrates adapter plate 40 for connection to a wide variety of attachments such as bucket and grapple 28 shown in phantom (grapple not shown for sake of clarity). A detailed description of the adapter plate 40 may be found in U.S. Pat. No. 3,672,521 to Bauer et al. which is hereby incorporated by reference. Those skilled in the art will recognize that the adapter plate 40 may take on a wide variety of forms such as the embodiment illustrated in FIG. 2. The purpose of adapter plate 40 is to provide a means for connecting the boom arms 17 to an attachment. Preferably, the adapter plate 40 includes suitable structure for releasable connection to an attachment. In addition, the adapter plate 40 preferably includes a mechanism for establishing the connection quickly and easily. The attachment mechanism may be manually operated or actuated by suitable power actuators to enable remote control of the connection to the attachment. Specifically, it is preferable to have a remotely operated attachment mechanism such that the operator residing in the cab 16 is able to establish a connection to an attachment without exiting the cab.

Adapter plate 40, which is generically referred to herein as an implement as described previously, includes, in this illustrated embodiment, an elongate member 42, two pairs of mounting brackets 44 and a locking mechanism (not shown) for securing the brackets 44 to an attachment, such as bucket and grapple 28. The brackets 44 may be secured to a reinforcement bar 46 and a reinforcement or back plate 48. A bottom plate 50 may also be provided to connect the bottom portions of the brackets 44. Elongate member 42 is connected to each of the brackets 44 and engages a top portion of the attachment.

The brackets 44 also include pivot points 30 in the form of holes to receive pins (not shown) for connection to the boom arm 17. The brackets 44 also include pivot points 36 in the form of holes to receive pins (not shown) for connection to the cylinders 32.

Figure 3A:
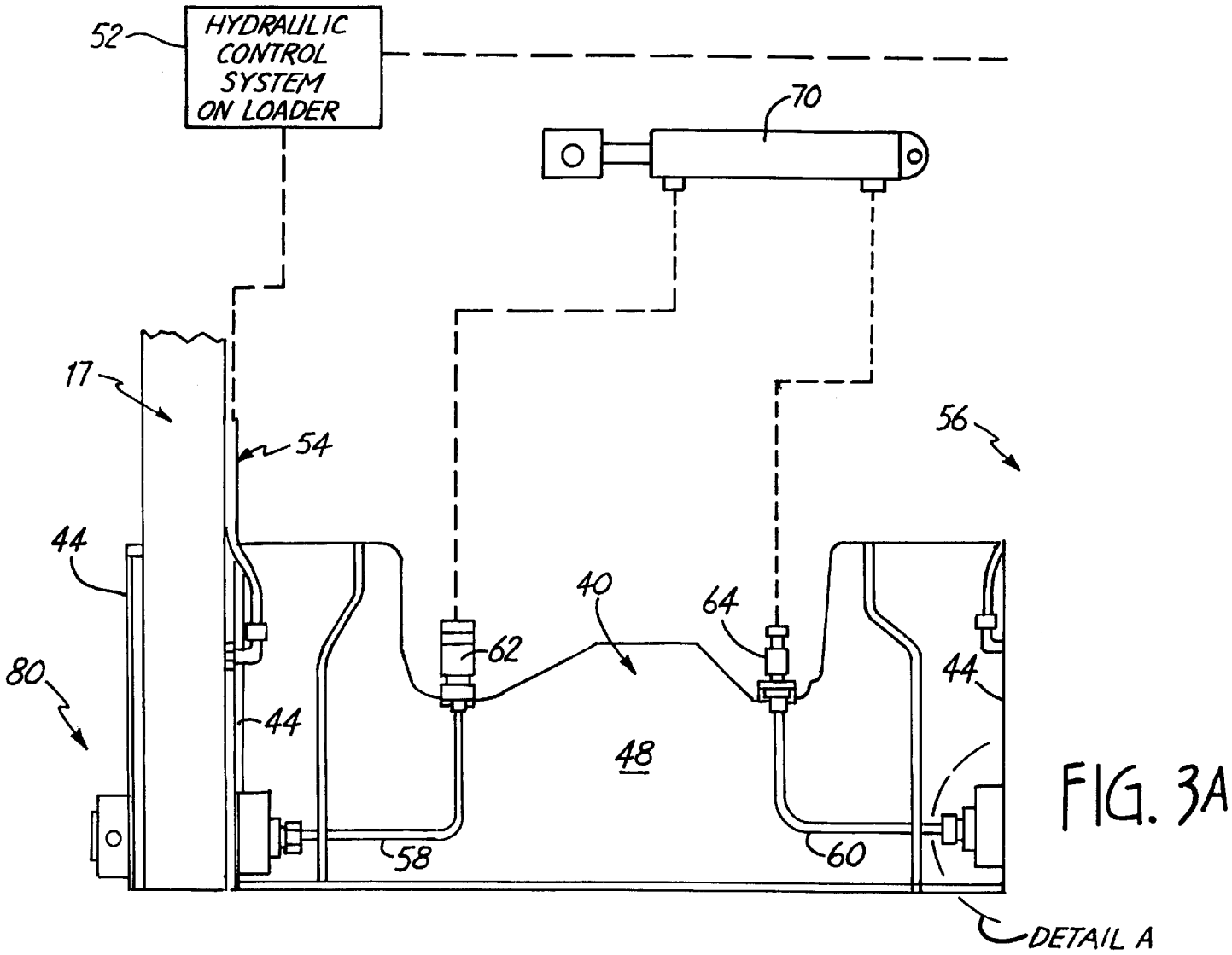
FIG. 3A is a rear view of an adapter connected to a pair of boom arms by way of a load bearing pivot assembly of the present invention.

Refer now to FIG. 3A which illustrates a rear view of attachment adapter plate 40 connected to boom arms 17 by load bearing pivot assemblies 80. The load bearing pivot assemblies 80 receive hydraulic fluid from the hydraulic control system 52 on the loader 10 by way of hydraulic lines 54 and 56. The hydraulic control system 52 on the loader 10 is only shown schematically and is well known in the art. Hydraulic fluid received from the hydraulic control system 52 passes through the hydraulic lines 54 and 56 into the load bearing pivot assemblies 80 and exit through hydraulic lines 58 and 60.

The hydraulic lines 54 and 56 are preferably at least partially contained within the boom arms 17. This protects the hydraulic lines 54 and 56 from damage due to the abusive environment. Similarly, hydraulic lines 58 and 60 are preferably, at least partially contained within the adapter plate 40. Protection for the hydraulic lines 54, 56, 58 and 60 may be provided by, for example, indents or recesses in the boom arms 17 and the attachment adapter plate 40. Those skilled in the art will recognize other suitable means to protect the hydraulic lines within the boom arms 17 and the adapter plate 40.

A pair of quick couplers 62 and 64 are preferably connected to the ends of hydraulic lines 58 and 60, respectively. The quick couplers 62 and 64 are, in turn, connected to a hydraulic actuator 70, which is shown as a double-acting cylinder for illustrative purposes only. The hydraulic actuator 70 generally represents any hydraulic actuator such as a hydraulic cylinder or a hydraulic motor utilized on the attachment.

With this arrangement, hydraulic fluid delivered from the hydraulic control system 52 on the loader 10 passes through hydraulic lines 54 and 56 preferably contained at least partially within the boom arms 17. The pressurized hydraulic fluid contained in the hydraulic lines 54 and 56 then passes through the load bearing pivot assemblies 80 and exits through hydraulic lines 58 nd 60. Hydraulic lines 58 and 60 are connected to a hydraulic actuator 70 by suitable connectors and lines such as quick couplers 62 and 64. Accordingly, the hydraulic control system 52 on the loader 10 controls the function of the hydraulic actuator 70 on the attachment (not shown) by way of the hydraulic lines 54, 56 through load bearing pivot assemblies 80 and through hydraulic lines 58 and 60.

Figure 3C:
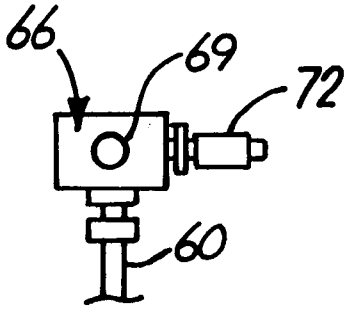
FIG. 3C is a side view of the block assembly illustrated in FIG. 3B.
Figure 3B:
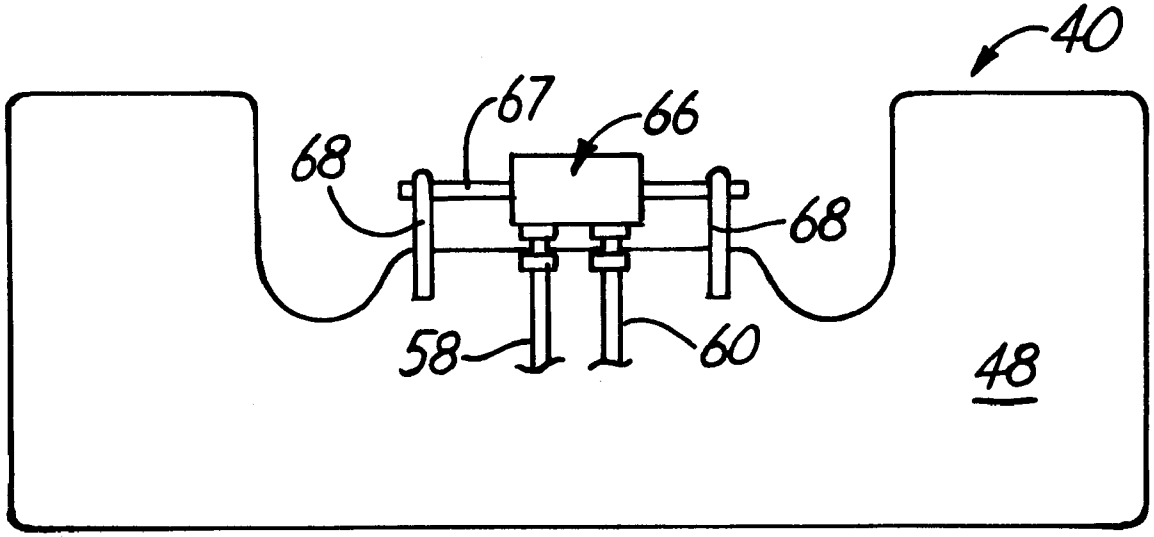
FIG. 3B is a rear view of a block assembly movably mounted to an adapter as in the present invention.

Refer now to FIG. 3B which illustrates a movable block assembly 66 for connecting pressure lines 58 and 60 to the hydraulic actuator 70 (not shown). The remaining portions of the loader 10 and attachment not illustrated in FIG. 3B are the same as those discussed previously. The movable block assembly 66 is connected to the adapter plate 40, and preferably the back plate 48, using rod 67 and brackets 68. Rod 67 may be welded to the back plate 48 by brackets 68. The movable block assembly 66, in turn, includes a hole 69 to receive the rod 67. With this arrangement, the movable block 66 is able to slide along the rod 67 and rotate about the axis of the rod 67. Those skilled in the art will recognize that there are many suitable ways to connect the movable block 66 to the adapter plate 40 such that the block 66 is capable of relative movement. Preferably, the block 66 is capable of both lateral and rotational movement with respect to the adapter plate 40.

With reference to FIG. 3C, movable block assembly 66 includes a quick coupler 72 in fluid communication with the hydraulic line 60. In a similar manner, another quick coupler (not shown) is connected to movable block assembly 66 and is in fluid communication with hydraulic line 58. The quick couplers, including quick coupler 72, and the other quick coupler (not visible) are adapted to be received by mating couplers on the attachment.

With this arrangement, the movable block 66 may be positioned relative to the attachment by moving the attachment adapter plate 40 with the hydraulic cylinders 22 and 32. Together with a remote lock mechanism for connecting the adapter plate 40 to the attachment as described previously, an operator may remain in cab 16 and maneuver the loader 10 to connect the adapter plate 40 and the hydraulic couplers on the movable block 66 to the attachment. In this manner, the operator may easily establish both hydraulic and physical connections between the loader 10 and the attachment without exiting the cab 16.

Figure 4:
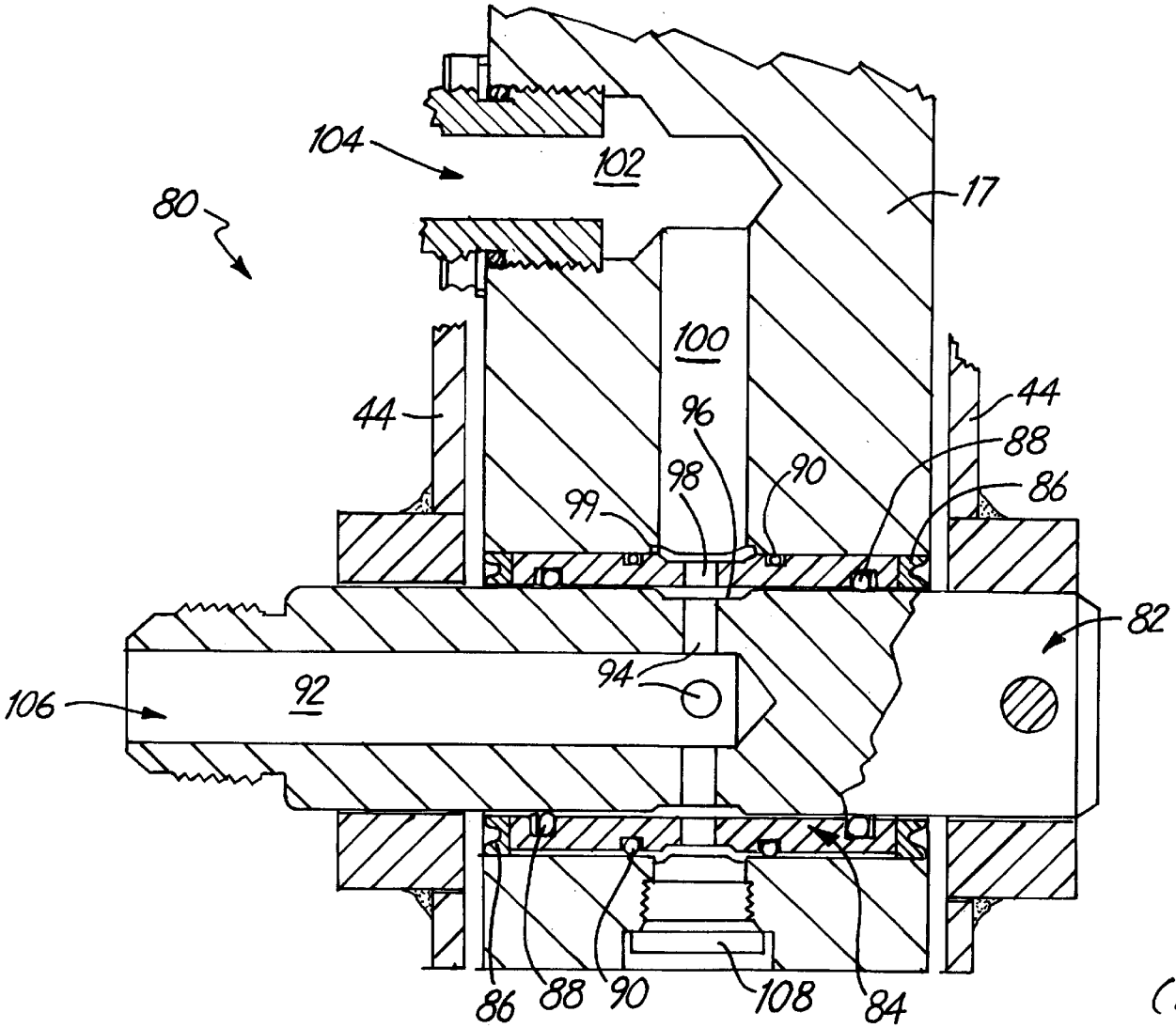
FIG. 4 is a partially cross-sectioned detail view of the load bearing pivot assembly illustrated in FIG. 3A.

Refer now to FIG. 4 which illustrates a partially cross-sectioned detailed view of the load bearing pivot assembly 80 of the present invention. The pivot assembly 80 includes a pin 82 rigidly secured to brackets 44 of the adapter plate 40. Surrounding pin 82 is annular bushing 84 which is pressed into a bore in boom arm 17, and which has wipers 86 and seals 88 adjacent the ends of the bore. The pin 82 freely rotates within the bushing 84.

Although the pivot assembly 80 illustrated in FIG. 4 illustrates the pin 82 rigidly connected to the adapter plate 40 and the bushing 84 rigidly connected to the boom arm 17, it is contemplated that the arrangement may be reversed. In other words, the pin 82 may be connected to the boom arm 17 and the bushing 84 may be connected to the attachment adapter plate 40. In this embodiment, the boom arm 17 may include two extension brackets (not shown) to connect to either side of the pin 82. Additionally, the attachment plate 40 may include a bearing housing (not shown) to contain the bushing 84. Those skilled in the art will recognize that many pivotal assemblies and arrangements are possible without departing from the spirit of the invention.

Pin 82 includes a longitudinal bore 92, one or more lateral bores 94 and an annular recess 96, which aligns with cross bores 98 in the bushing 84. In this manner, a fluid path is defined through the center of pin 82 to the cross bores 98. The annular bushing 84 includes holes 98 which are disposed adjacent the annular recess 96 in the pin 82. An inlet or entrance port 104 for hydraulic fluid opens to a cross bore 102 which intersects a bore in the boom arm 17. The bore 100 is in fluid communication with the cross bores 98 in the bushing 84. An annular recess 99 is formed surrounding the bores 98, either in bushing 84 or in the bore in boom arm 17 holding the bushing. O-rings 90 seal the recess 99. With this arrangement, fluid inlet or entrance port 104 is in communication with an exit port 106 of pin 82 by way of cross bore 102, bore 100, annular recess 99, bores 98, annular recess 96, bores 94, and longitudinal bore 92. Since a fluid-tight seal is provided between the pin 82 and the bushing 84, and between bushing 84 and its bore in boom arm 17 (with seals 90) a fluid-tight path is established between the entrance port 104 and the exit port 106.

The entrance port 104 may be coupled to the hydraulic lines 56 or 54 depending on which side the pivot assembly 80 is located. Similarly, the exit port 106 may be connected to the hydraulic lines 58 or 60 depending on which side the pivot assembly 80 is located. In essence, the load bearing pivot assembly 80 provides a pivotable connection between the boom arm 17 and the adapter plate 40 in addition to a fluid path therethrough. This construction eliminates hydraulic fluid lines at the pivot points which would otherwise be susceptible to failure due to repeated flexure and/or due to exposure to an abusive environment.

As fluid flows from the entrance port 104 to the exit port 106 of the pivot assembly 80, the hydraulic fluid flows along the bearing surfaces of the bushing 84 and the pin 82.

Because most hydraulic fluids have an inherent lubricant property, the flow of hydraulic fluid through the pivot assembly 80 automatically lubricates the bearing surfaces of the bushing 84 and pin 82. Pivot assembly 80 also includes a removable plug 108 that plugs bore 100 at its outer end. It can be used for draining hydraulic fluid from the pivot assembly 80.

The load bearing pivot assembly may also be utilized at pivot point 20 between the boom arm 17 and the main frame 12. Hydraulic lines passing from the main frame 12 to the boom arm 17 could be routed through the load bearing pivot assembly 80 located at pivot point 20 and thereby eliminate the need for hydraulic lines at pivot point 20 which would otherwise be susceptible to failure due to repeated flexure and exposure to the abusive environment.

Although the present invention has been described with reference to preferred embodiments, those skilled in the art will recognize that changes may be made in form and detail without departing from the spirit and scope of the invention, as described in the appended claims.

What is claimed is:

1. A power machine, comprising:

a boom arm having a distal end;

an implement; and a load bearing pivot assembly for pivotally connecting the implement to the distal end of the boom arm, the pivot assembly including a first portion defining a first fluid path including a passageway in the boom arm having a first end spaced from the pivot assembly and having a second end opening to a bore in the distal end of the boom arm and a second portion comprising a pin in the bore for retaining the implement, the pin having a second fluid path and being connected to the implement, the first fluid path being in fluid communication with the second fluid path at a location within the bore, the second fluid path including a portion extending along an axis of the pin and opening to one end of the pin.

2. A power machine as in claim 1 wherein the implement comprises an adapter plate.

3. A power machine as in claim 1 wherein the first fluid path includes a first connector at the first end for connection to a first fluid line, and wherein the second fluid path includes a second connector at the opening at the end of the pin for connection to a second fluid line.

4. A power machine as in claim 3 wherein the first fluid line is connected to a source of pressurized hydraulic fluid.

5. A power machine as in claim 3 wherein the implement includes an adapter plate and an attachment mounted on the adapter plate, and having a hydraulic motor, and wherein the second fluid line is connected to the hydraulic motor on the attachment.

6. A power machine as in claim 3 wherein the implement includes a hydraulic motor, and the second fluid line is releasably coupled to the hydraulic motor.

7. A power machine as in claim 3 wherein the second fluid line is connected to a block movably connected to the implement, the block including a coupler for releasably coupling to an attachment.

8. A power machine as in claim 1 wherein the first portion comprises an annular bearing fixed on the bottom arm and surrounding the pin.

9. A power machine as in claim 8 wherein the second fluid path is in the pin and includes an annular recess in fluid communication with a lateral channel in the pin and the portion of the second fluid path extending along the axis of the pin, and wherein the annular recess is in fluid communication with the second end of the first fluid path.

10. A power machine as in claim 9 wherein the annular bearing includes an opening in fluid communication with the annular recess of the pin, and wherein the opening aligns with the annular recess.

11. A power machine as in claim 10 wherein the bearing includes a bearing surface in fluid communication with one of the fluid paths such that a fluid from one of the fluid paths lubricates the bearing surface.

12. A power machine, comprising:

a first boom arm and a second boom arm each having a distal end and being spaced apart and having facing surfaces;

an implement;

a first load bearing pivot assembly for pivotally connecting the implement to the distal end of the first boom arm, the first pivot assembly including a first part forming a bearing and a second part pivotable in the bearing and a first fluid path defined therethrough;

a second load bearing pivot assembly for pivotally connecting the implement to the distal end of the second boom arm, the second pivot assembly including a first part forming a bearing and a second part pivotable in the bearing and a second fluid path defined therethrough; and each of the first and second fluid paths being coupled to a fluid path portion that extends through a portion of the respective boom arm, and each fluid path portion having an opening at the respective facing surface of the respective boom arm at a location spaced from the distal end of the respective boom arm.

13. A power machine, comprising:

an implement frame assembly;

a lift arm having first and second ends, the first end being pivotally mounted to the power machine so the second end can be raised and lowered; and a load bearing pivot assembly for pivotally connecting the implement frame assembly to the end of the second end of the lift arm, the pivot assembly including a first portion comprising a sleeve having an opening defining a first fluid path and being rigidly connected to the end of the lift arm, and a second portion comprising a pin defining a second fluid path from an exterior of the pin aligned with the opening in the sleeve and extending in the pin to one end thereof, the pin being connected to the implement frame assembly, the first portion pivotally mounting the pin, the first fluid path being in fluid communication with the second fluid path through the opening and the first fluid path having a portion extending along the lift arm and opening at a location along the lift arm spaced from the pivot assembly and positioned between the first and second ends of the lift arm for connecting to a source of fluid under pressure on the power machine.

14. A power machine as in claim 13 wherein a portion of the second fluid path at the exterior surface of the pin includes an annular recess in fluid communication with the opening.

15. A power machine as in claim 14 wherein the opening in the sleeve comprises a gap in fluid communication with the annular recess of the pin, and wherein the gap comprises a portion of the first fluid path.

16. A power machine as in claim 15 wherein the bearing includes a bearing surface in fluid communication with one of the fluid paths such that a fluid from one of the fluid paths lubricates the bearing surface.

17. The power machine of claim 11, wherein the bearing surface comprises a bearing sleeve, said bearing sleeve having an opening therethrough in fluid communication with the second end of the first fluid path, and first seals carried on the bearing sleeve on opposite sides of the second end of the first fluid path, and second seals on an interior bore of the bearing sleeve sealing on the pin, and positioned adjacent opposite ends of the bore.

* * * * *